United States Patent [19]

Ellis et al.

[11] Patent Number: 4,633,646

[45] Date of Patent: Jan. 6, 1987

[54] CAPPING HEAD

[75] Inventors: Darwin L. Ellis; Frank M. Kelly, both of Richmond, Ind.

[73] Assignee: Aluminum Company of America, Pittsburgh, Pa.

[21] Appl. No.: 792,579

[22] Filed: Oct. 29, 1985

[51] Int. Cl.[4] ..... B67B 1/06; B65B 7/28

[52] U.S. Cl. ..... 53/331.5; 53/317

[58] Field of Search ..... 53/331.5, 317, 306, 53/362, 367, 368

[56] References Cited

U.S. PATENT DOCUMENTS

| | | | |
|---|---|---|---|
| 2,884,751 | 5/1959 | Bjering | 53/317 |
| 3,405,499 | 10/1968 | Dexter | 53/331.5 |
| 3,491,516 | 1/1970 | Bergeron | 53/331.5 X |
| 3,955,341 | 5/1976 | Wilhere | 53/331.5 |
| 3,984,965 | 10/1976 | Sonnenberg | 53/331.5 |
| 4,364,218 | 12/1982 | Obrist | 53/331.5 |
| 4,492,068 | 1/1985 | Obrist | 53/331.5 |

*Primary Examiner*—Horace M. Culver

*Attorney, Agent, or Firm*—Thomas J. Connelly

[57] ABSTRACT

A capping head for screwing a prethreaded closure onto a container provided with a screw thread. The capping head includes a housing adapted to be secured to a rotatable drive spindle and having a bore formed therein which is open at one end. A quill is mounted in the housing for free rotation therewith. The quill contains two radial bores which house a pair of poppet valves. The capping head also includes a torque-dependent clutch having a drive plate secured to the housing and a driven plate secured to the quill. The clutch is constructed such that it will stop screwing a prethreaded closure onto a container once a desired, predetermined torque value is reached. A chuck is attached to the driven plate and is fluidly activated between an open and closed position by the poppet valves. An activating arm is also present which is attached to the quill and cooperates with a cam formed on an inner peripheral surface of the housing to selectively operate the poppet valves when the torque value between the drive plate and the driven plate exceeds the desired, predetermined value.

22 Claims, 17 Drawing Figures

Fig. 4
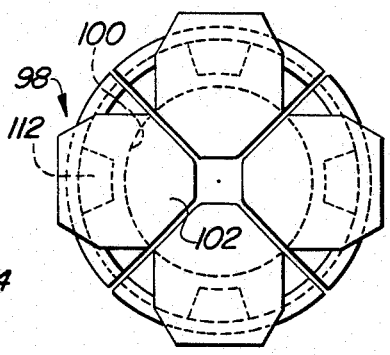
Fig. 6
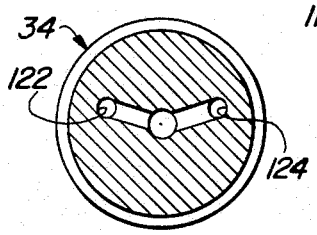
Fig. 8
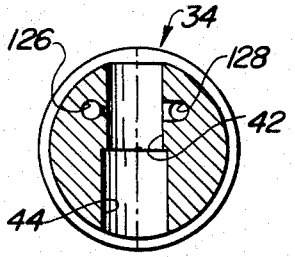
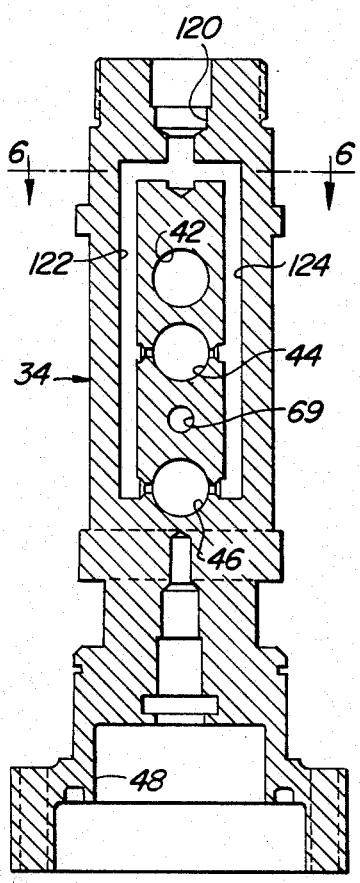
Fig. 5
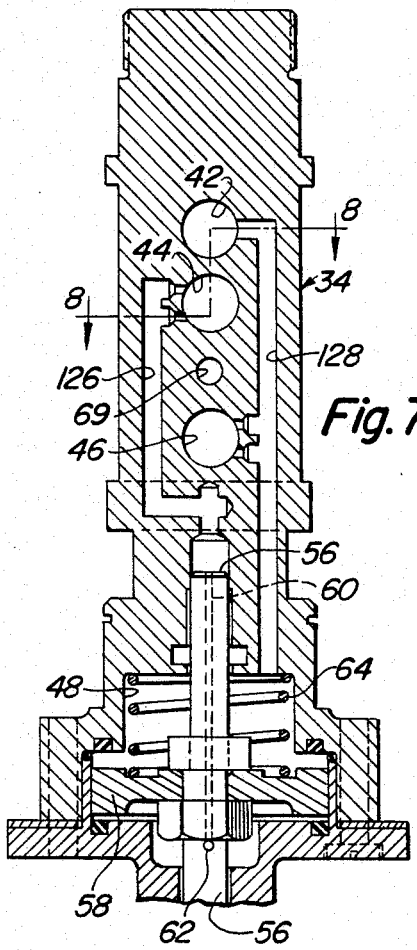
Fig. 7

CAPPING HEAD

FIELD OF THE INVENTION

This invention relates to a capping head for screwing prethreaded closures onto containers provided with a screw thread.

BACKGROUND OF THE INVENTION

Various forms of capping heads are currently on the market for applying plastic and aluminum closures onto containers. Until recently, non-threaded closures were inserted onto the neck of a container and a capping head came down and formed the closure to the shape of the bottle's neck. With the advent of plastic closures, it became possible to mold the threads into the closure such that it was no longer necessary to form the closure on the container's neck. With prethreaded closures, it became customary to place the closure on the container's neck and then move the container into alignment with a capping head which would come down, contact the closure, and screw it onto the container. The closure would be tightened to a predetermined desired torque by a non-frictional magnetic clutch which was located between the chuck and the quill portion of the capping head. See U.S. Pat. Nos. 4,364,218 and 4,492,068, and U.S. Ser. No. 602,237, filed Apr. 19, 1984 and assigned to Aluminum Company of America. Such capping heads worked satisfactorily provided the prethreaded closure was initially placed squarely upon the container's neck. Problems would occur, however, when the closure was cocked or angled relative to the container's neck. In such situations, the threads on the screw closures were susceptible to cross-threading or the closures would not be tightened satisfactorily before the magnetic clutch disengaged.

Now a capping head has been invented which places a prethreaded closure squarely on a prethreaded container and tightens it down to a predetermined torque value.

SUMMARY OF THE INVENTION

Briefly, the present invention relates to a capping head which is designed to screw prethreaded closures onto containers provided with a screw thread. The capping head is designed to grip a prethreaded closure and position it over the neck portion of a container and screw the closure onto the container. The capping head includes a housing adapted to be secured to a rotatable spindle and having a quill mounted therein which is free to rotate with respect to the housing. The quill contains a pair of radially aligned poppet valves and an activating arm pivotally attached between the poppet valves. One end of the activating arm carries a cam follower which contacts a cam surface formed on the inside surface of the housing. The capping head also includes a clutch having a drive plate connected to the housing and a driven plate connected to the quill. Further attached to the driven plate is a chuck for gripping a prethreaded closure. The chuck is fluid activated between opened and closed positions by operation of the poppet valves. When the torque between the drive plate and the driven plate exceeds a desired predetermined value, the cam follower traverses the cam surface and selectively activates one of the two poppet valves, which in turn routes pressurized fluid through the quill to activate the chuck.

The general object of this invention is to provide a capping head. A more specific object of this invention is to provide a capping head which will screw prethreaded closures onto containers provided with screw threads.

Another object of this invention is to provide a capping head which will screw prethreaded closures onto containers at a faster speed than conventional capping heads.

Still further, an object of this invention is to provide a capping head which initially grips a prethreaded closure and positions it over the neck portion of a container before the closure is screwed onto the container.

A further object of this invention is to provide a capping head which will screw prethreaded closures onto the neck portions of containers at uniform torque values.

Other objects and advantages of the present invention will become more apparent to those skilled in the art in view of the following description and the accompanying drawings.

BRIEF DESCRIPTION OF THE DRAWINGS

FIG. 4 is an end view of the four gripper fingers in a closed position taken along line 4—4 of FIG. 1*b*.

FIG. 5 is a cross-sectional view of the quill showing the internal passages to the poppet valves.

FIG. 6 is a sectional view taken along line 6—6 of FIG. 5.

FIG. 7 is a cross-sectional view of the quill and the second piston showing the internal passages between the poppet valves and the first and second pistons.

FIG. 8 is a sectional view of the quill taken along line 8—8 of FIG. 7.

DETAILED DESCRIPTION OF THE PREFERRED EMBODIMENT

Figure 1A:
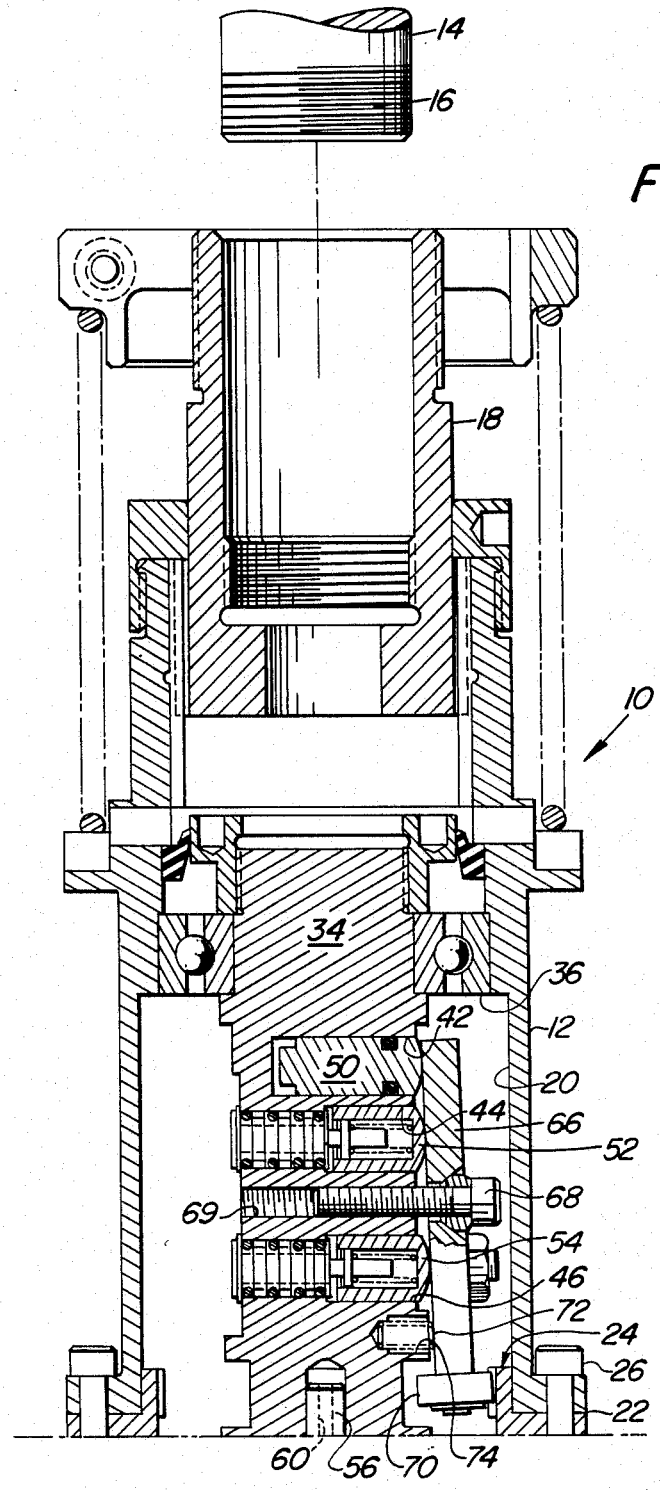
FIGS. 1*a* and 1*b* are upper and lower sectional views, respectively, of a capping head containing a finger gripping chuck, a magnetic torque-dependent clutch and a quill containing poppet valves which are selectively activated by an activating arm and cam arrangement.
Figure 1B:
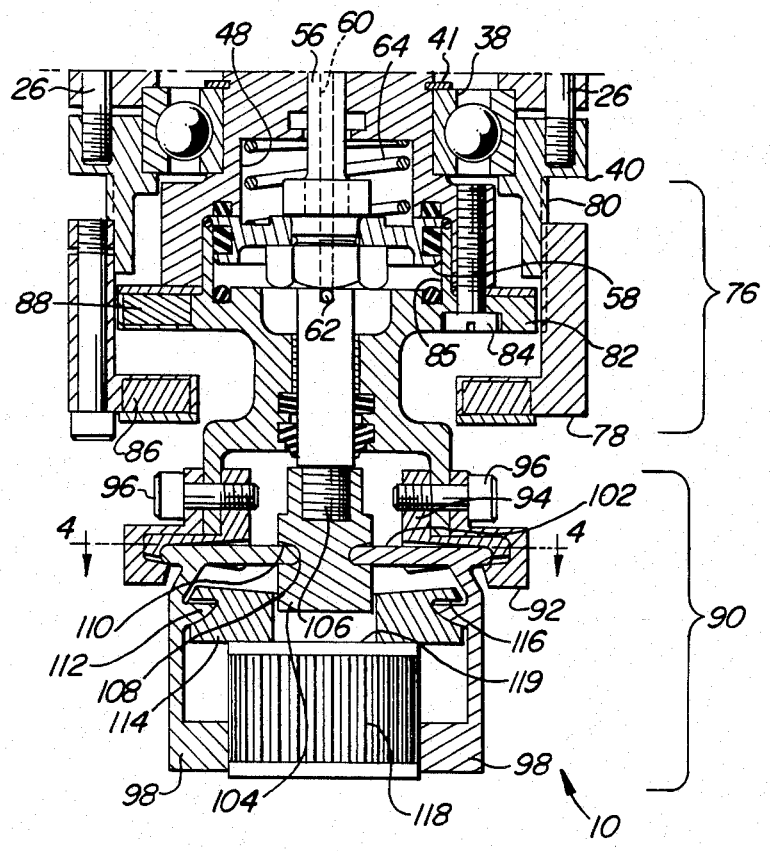
Figure 2:
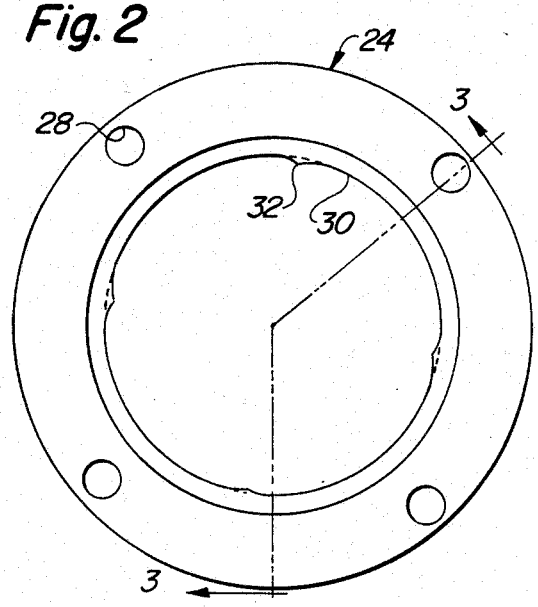
FIG. 2 is a top view of a cam used in the capping head.
Figure 3:
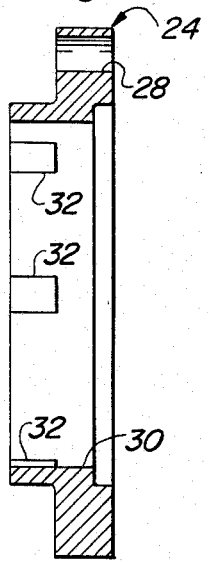
FIG. 3 is a side view of the cam taken along the line 3—3 in FIG. 2.

Referring to FIGS. 1*a* and 1*b*, a capping head 10 is shown having a housing 12 adapted to be secured to a rotatable drive spindle 14. The drive spindle 14 contains screw threads 16 which engage in a mounting hub 18 secured to one end of the housing 12. The housing 12 contains an axial bore 20 which has an open end 22 aligned opposite to the mounting hub 18. The housing 12 also has a cam member 24 attached thereto, see FIGS. 1*a*, 2 and 3. The cam member 24 is shown as a separate part which mounts to the housing 12 by a plurality of bolts 26. The bolts 26 are received in bores 28 formed in the cam member 24. It should be noted that the cam member 24 can be integrally formed with the housing 12 if desired. The cam member 24 has a cam surface 30 which includes at least one and preferably four raised notches 32. The notches 32 activate a cam follower which traverses the cam surface 30. The exact number of notches which can be used and the spacing between the notches direct the movement of the cam follower and can be varied to suit one's particular needs.

The housing 12 has a quill 34 mounted therein on a pair of bearings 36 and 38. The bearings 36 and 38 permit the quill 34 to rotate freely with respect to the housing 12. The bearing 36 is press-fitted into an inner peripheral surface of the housing 12 while the bearing 38 is held in place by a bearing cap 40 and a retainer ring 41. The bearing cap 40 is connected to the housing 12 by the bolts 26 which passed through the bores 28 formed in the cam member 24.

The quill 34 contains three radial bores 42, 44 and 46, which are arranged in line along the longitudinal axis of the quill 34, and a coaxial bore 48 which is opened at one end. The open end of the bore 48 is adjacent to the open end 22 of the housing 12. A first piston 50 is movably positioned in the radial bore 42 and is biased outwardly by pressurized fluid, preferably air. Movably positioned in the bores 44 and 46 are first and second poppet valves 52 and 54, respectively, which are biased outwardly by spring force. Preferably, the poppet valves 52 and 54 are 3-way, 2-position poppet valves. An elongated piston rod 56 is movably positioned in the coaxial bore 48 and has a second piston 58 secured thereto. The piston rod 56 is also movable by pressurized fluid, such as air, relative to the quill 34. In order to permit pressurized air to be routed to the lower surface of the second piston 58, a passageway 60 is formed through the piston rod 56 which terminates at a circumferentially located port 62 situated on the lower side of the second piston 58. A spring 64 is positioned in the coaxial bore 48 between the quill 34 and the upper surface of the second piston 58 and serves to bias the second piston 58 away from the quill 34. As used throughout this application, upper and lower surfaces will refer to the orientation of the capping head 10 as viewed in FIGS. 1*a* and 1*b*.

Referring again to FIG. 1*a*, the quill 34 has an activating arm 66 pivotally attached thereto by a bolt 68 such that the arm 66 can selectively operate either the first or second poppet valve 52 or 54, respectively. The bolt 68 is threaded into a threaded bore 69 which is preferably formed in the quill 34 between the bores 44 and 46. Attached to one end of the arm 66 is a cam follower 70 which is in constant contact with the cam surface 30. To assure that the constant contact is maintained, a spring 72 is positioned close to the cam follower 70 in a shallow bore 74 formed in the quill 34. The spring 72 biases the arm 66 outward away from the quill 34. The opposite end of the arm 66 contacts the first piston 50 and controls its outward movement. When the cam follower 70 moves inward toward the center of the quill 34 by rolling over one of the notches 32, the arm 66 pivots on the bolt 68 and permits the first piston 50 to move outward under the influence of pressurized air. The specific movements of the poppet valves 52 and 54 and the pistons 50 and 58, relative to the position of the cam surface 30, will be explained shortly.

Referring to FIG. 1*b*, the capping head 10 employs a torque dependent clutch 76 which is preferably a non-frictional magnetic clutch. The clutch 76 consists of a drive plate 78 which is attached to the bearing cap 40 by threads 80. The threads 80 permit axial adjustment of the drive plate 78 relative to both the housing 12 and the bearing cap 40. The clutch 76 also has a driven plate 82 which is permanently attached over the opened end of the quill 34 by machine screws 84. Preferably, an inner circumferential surface 85 of the driven plate 82 provides a bore within which the second piston 58 can reciprocate. The driven plate 82 also serves as a stop to limit the downward movement of the second piston 58 away from the quill 34.

Both the drive plate 78 and the driven plate 82 contain a plurality of cylindrical permanent magnets 86 and 88, respectively, which are arranged in a circumferentially spaced relationship. The magnets 86 and 88 are mounted on facing surfaces of the drive plate 78 and the driven plate 82, and the poles of the magnets 86 and 88 are arranged so that the drive plate 78 and the driven plate 82 attract each other at least in one relative position. There are an even number of magnets 86 and 88 arranged alternately in a north-south pole relationship. In our capping head 10, eight magnets 86 are secured to the drive plate 78 and eight equal strength magnets 88 are secured to the driven plate 82. When eight facing magnets 86 and 88 are used, four stable pole positions are created in a 360° revolution when the north poles on the magnets 86 coaxially align with the south poles on the magnets 88. For each such alignment, a notch 32 must be present on the cam surface 30. This can be accomplished by providing a plurality of notches 32 on the cam surface 30 numbering equal to half the number of magnets 86 on one of the plates 78 or 82. For example, when four notches 32 are equally spaced on the cam surface 30 corresponding to eight magnets 86 in each of the plates 78 and 82, the travel of the cam follower 70 will be 90° for each prethreaded closure 118 to be screwed onto a container.

The clutch 76 can be set to a desired, predetermined torque by controlling the air gap between the permanent magnets 86 and 88. In the embodiment shown in FIG. 1*b*, this is easily accomplished by screwing the drive plate 78 further onto the bearing cap 40 when one wishes to increase the torque value and by unscrewing the drive plate 78 from the bearing cap 40 when the torque value is to be reduced. When the torque value between the drive plate 78 and the driven plate 82 is substantially below the preselected value, the drive plate 78, the housing 12, the driven plate 82 and the quill 34 will all rotate at the same speed and in the same direction as the drive spindle 14. As the torque value between the plates 78 and 82 approaches the preselected torque value, slippage occurs and the driven plate 82 and the quill 34 will begin to rotate at a slower speed than the housing 12. When this occurs, the cam follower 70 will start to traverse the cam surface 30. Once the desired torque value is reached or exceeded, the driven plate 82 and the quill 34 will stop rotating and this permits the cam follower 70 to traverse a greater segment of the cam surface 30. The activating arm 66 will in turn pivot once the cam follower 70 encounters one of the notches 32. The use and performance of magnetic clutches is described in U.S. Pat. No. 4,364,218 and also in U.S. Ser. No. 602,237, filed Apr. 19, 1984, assigned to Aluminum Company of America, both of which are incorporated by reference and made a part hereof.

A chuck 90, which includes a support 92 and a guide ring 94, is attached to an outer end of the driven plate 82 by cap screws 96. The chuck 90 also includes a plurality of gripper fingers 98, of which there are at least two and preferably four, each having a concave gripping surface 100, best seen in FIG. 4. Each finger 98 contains a flat pie-shaped base 102 which is pivotally retained between the guide ring 94 and a support nut 104. The support nut 104 is secured to the outer end of the piston rod 56 by threads 106. The support nut 104 contains a circumferential groove 108 on its outer periphery which has a tapered surface 110 angled downward and outward toward the driven plate 82. The circumferential groove 108 receives the inner end of the base 102 of each finger 98 and permits the base 102 to pivot relative to the guide ring 94 as the support nut 104 is moved axially downward away from the quill 34. Each gripper finger 98 also contains an inwardly extending tab 112 distally spaced from the base 102. The tabs 112 cooperate with the support nut 104 to hold a pressure plate 114 in place. The tabs 112 project into a circumferential slot 116 formed in the outer periphery of the pressure plate 114. The pressure plate 114 is preferably constructed of plastic or hard rubber and can act as a cushion and rest for the top of a prethreaded closure 118. When four gripper fingers 98 are used, it is advantageous to arrange the fingers 98 in a circular pattern with each finger 98 being offset 90° from the adjacent fingers.

The chuck 90 is constructed such that as the piston rod 56 and the attached support nut 104 move axially downward away from the quill 34, the gripper fingers 98 will pivot on the guide ring 94 to an open position. In the open position, the chuck 90 will be capable of receiving the prethreaded closure 118 within the opening defined by the concave gripping surfaces 100. Movement of the piston rod 56 and support nut 104 axially upward toward the quill 34 will cause the gripper fingers 98 to pivot on the guide ring 94 to a closed position wherein the concave gripping surfaces 100 will grip the outside surface of the prethreaded closure 118. In this position, the prethreaded closure 118 will be held secure with its outer top surface 119 contacting the pressure plate 114. The prethreaded closure 118 will rotate at the same speed as the driven plate 82 and the quill 34.

Referring to FIGS. 5 and 6, pressurized air of approximately 50 to 125 pounds per square inch is supplied from a supply source (not shown) through a central passage 120 formed in the quill 34. The incoming air is directed through two smaller passages 122 and 124 and is routed to the first and second bores 44 and 46. The first and second bores 44 and 46 house the first and second poppet valves 52 and 54, respectively. In this particular embodiment, the two passages 122 and 124 are used to guarantee that the first and second poppet valves 52 and 54, respectively, receive an adequate volume of pressurized air. However, depending upon the application, one air passage may be sufficient. Furthermore, the air passage could have a larger diameter or the diameter could be kept the same if the required air volume was less.

Figure 10:
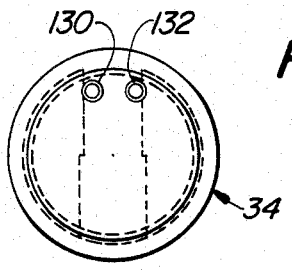
FIG. 10 is an end view of FIG. 9.
Figure 9:
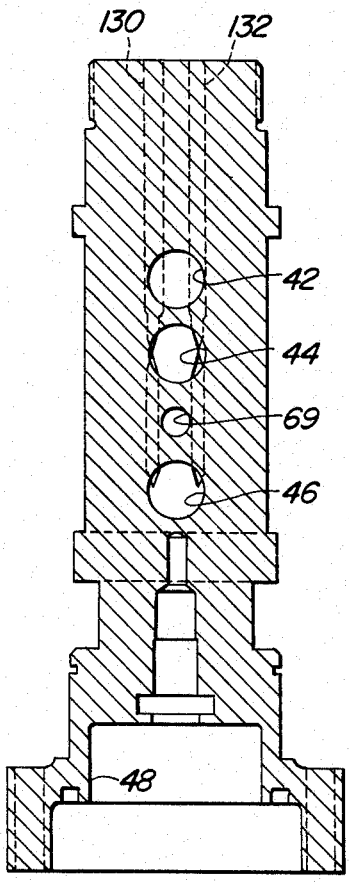
FIG. 9 is a cross-sectional view of the quill showing the exhaust passageways.

Referring to FIGS. 7 and 8, the pressurized air which enters the first and second bores 44 and 46 passes through the poppet valves 52 and 54 and is routed onto the first and second pistons 50 and 58, repsectively, through passages 126 and 128. The pressurized air from bore 44 is routed through passage 126 to the upper end of the piston rod 56. This air then passes through the passageway 60 and the port 62 and impinges upon the lowermost surface of the second piston 58. This pressurized air causes the second piston 58 to move upward toward the quill 34 which in turn causes the gripper fingers 98 to move to their closed position. At this time, the second poppet valve 54 will move to a position permitting air in the coaxial bore 48 and above the second piston 58 to be routed back through the passage 128 and into the second bore 46. Also, pressurized air which is used to hold the first piston 50 in an out position can be vented through the same passage 128 to the second bore 46. The air that is to be vented from the first and second bores 44 and 46, respectively, is routed through exhaust passages 130 and 132 to the atmosphere as is shown in FIGS. 9 and 10. It should be noted that the passages 126 and 128, shown in FIGS. 7 and 8, serve to alternatively supply and vent pressurized air to and from the upper and lower surfaces of the second piston 58. The passage 128 also supplies and vents air to and from the first piston 50. Therefore, the position of the first and second pistons 50 and 58, respectively, will depend upon the position of the first and second poppet valves 52 and 54, respectively, relative to their positions in the bores 44 and 46. For example, when the second poppet valve 54, located in the bore 46, is positioned such that pressurized air can flow through the passage 128, the first piston 50, located in the bore 42, will be biased outwardly. Simultaneously, pressurized air will enter the coaxial bore 48 and cause the second piston 58 to move downward away from the quill 34. The downward movement of the piston 58 forces the air below the second piston 58 out through the port 62, the passageway 60 and the passage 126 back through the first poppet valve 52 and through the exhaust passage 130 to the atmosphere. This permits further downward movement of the second piston 58 such that the gripper fingers 98 will pivot to their open position.

OPERATION

Figure 11:
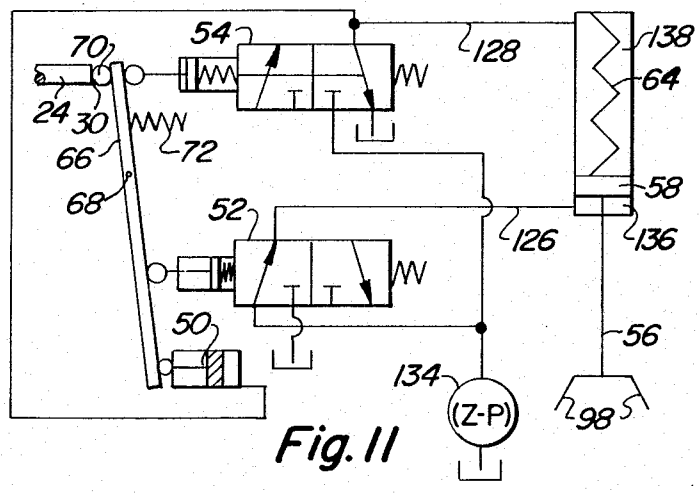
FIG. 11 is a schematic of the fluid flow path between the poppet valves and the pistons showing the fingers of the chuck in an open position and the upper chamber of the second piston open to an exhaust passage.

The operation of the capping head 10 will be explained by use of schematics shown in FIGS. 11–16. Referring to FIG. 11, the first poppet valve 52 is shown in an in position and the second poppet valve 54 is shown in an out position such that the arm 66 and cam follower 70 are biased against the cam member 24. This figure represent the start position wherein the gripper fingers 98 are open and the second piston 58 is in a down position biased by the spring 64. The system is currently at zero pressure since an air valve 134 is in a closed position and the passage 128 is open to the atmosphere via the second poppet valve 54. At this time the capping head 10 is in a down position ready to grip a prethreaded closure 118 before it moves up and over into alignment with the neck of a bottle.

Figure 12:
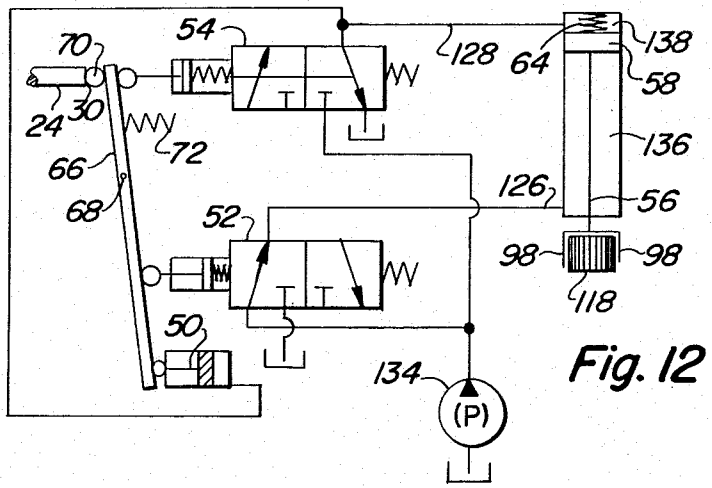
FIG. 12 is a schematic of the fluid flow path between the poppet valves and the pistons showing the fingers of the chuck in a closed position.

Referring to FIG. 12, the air valve 134, which can be an air valve as described in U.S. Ser. No. 792,500, filed on Oct. 29, 1985, and assigned to Aluminum Company of America, is opened and the air pressure is brought up to a pressure ranging between 50 and 125 psi. This air pressure is directed to the lower surface of the second piston 58 causing it to move upward against the spring 64 and close the fingers 98 about a prethreaded closure 118. As pressurized air is routed through the first poppet valve 52 and the passage 126 to a lower chamber 136 of the cylinder, the air in an upper chamber 138 of the cylinder is vented through the passage 128 and through the second poppet valve 54 to the atmosphere. One will notice that the poppet valves 52 and 54 have not changed positions from FIG. 11 to FIG. 12, but instead the only difference is that pressurized air has entered the system through the air valve 134 and the second piston 58 has moved upward causing the fingers 98 to close and grip the closure 118. At this time the capping head 10 also moves vertically upward and in a circular arc into alignment with a prethreaded container which is to be capped. The prethreaded closure 118 is then lowered into contact with the neck of the container.

Figure 13:
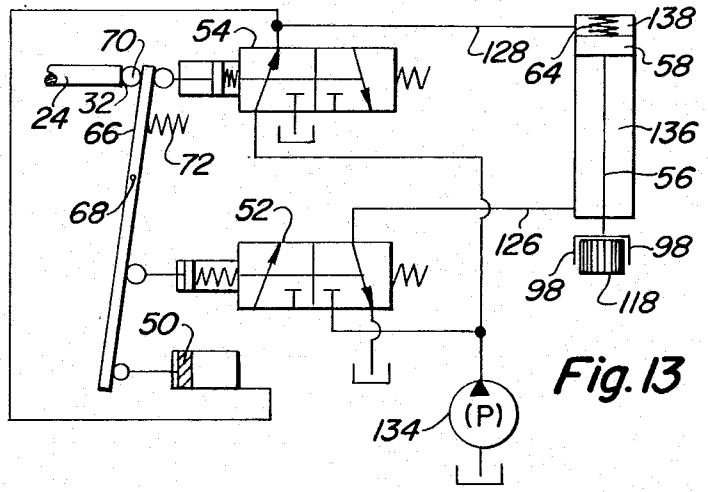
FIG. 13 is a schematic of the fluid flow path between the poppet valves and the pistons showing the fingers of the chuck in a position to start releasing a prethreaded closure.

Referring to FIG. 13, as the closure 118 is tightened onto the prethreaded container, the torque value exerted on the quill 34 increases to a point wherein the quill 34 stops rotating relative to the housing 12. When this occurs, the cam follower 70 traverses the cam surface 30 and encounters one of the notches 32 formed thereon. The notch 32 forces the cam follower 70 to move inwardly toward the quill 34 which causes the arm 66 to pivot on the bolt 68. This causes the second poppet valve 54 to move inward. At the same time, the arm 66 moves away from the first poppet 52 which is spring biased to move outward. The mechanical shift of the two poppet valves 52 and 54 causes the pressurized air from the air valve 134 to be routed to the inner surface of the first piston 50 via the extension of the passage 128. This causes the piston 50 to move outward against one end of the arm 66. In this position, the arm 66 is prevented from pivoting back to its initial position shown in FIG. 11.

Figure 14:
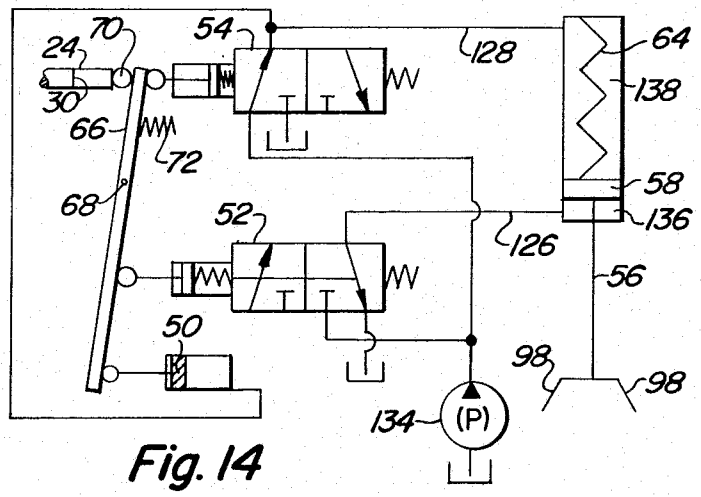
FIG. 14 is a schematic of the fluid flow path between the poppet valves and the pistons showing the fingers of the chuck in an open position and the lower chamber of the second piston open to an exhaust passage.

Referring now to FIG. 14, the pressurized air from the air valve 134 is routed through the second poppet valve 54 and through the passage 128 to the upper chamber 138 of the second piston 58. At the same time, the air in the lower chamber 136 is permitted to vent through the passage 126 and the first poppet valve 52 to the atmosphere. This flow path allows the second piston 58 to move downward under the influence of the pressurized air entering the upper chamber 138 in cooperation with the mechanical spring 64. The downward movement of the second piston 58 causes the fingers 98 to open. At this time the capping head 10 is still in the down position with the chuck 90 positioned adjacent to the neck of the prethreaded container. Once the fingers 98 release the closure 118, the quill 34 finds its next preferred position, determined by the magnets 86. Also, the arm 66 rotates past the notch 32. Air pressure in the passage 128 holds the piston 50 outward against the arm 66 which holds the second poppet valve 54 in position to keep fingers 98 open.

Figure 16:
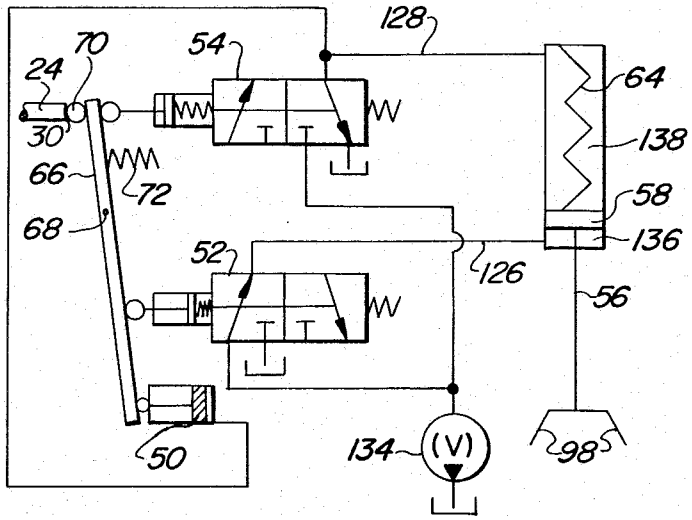
FIG. 16 is a schematic of the fluid flow path between the poppet valves and the pistons showing the fingers of the chuck in an open position and the lower chamber of the second piston vented to the atmosphere via the first poppet valve.
Figure 15:
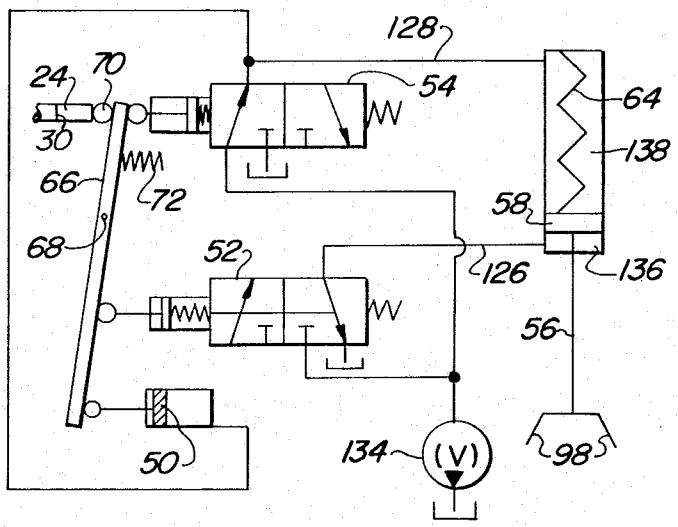
FIG. 15 is a schematic of the fluid flow path between the poppet valves and the pistons showing the fingers of the chuck in an open position and the upper chamber of the second piston vented to the atmosphere via the second poppet valve.

Referring to FIG. 15, the supply of pressurized air to the system is terminated and the air valve 134 is moved to a position wherein it vents the air to the atmosphere. When this occurs, the pressurized air holding the first piston 50 outwardly and the pressurized air from the upper chamber 138 of the second piston 58 is released through the second poppet valve 54 and through the air valve 134. At this time, the capping head 10 is still in the downward position but the container which has been capped has been routed away. It should be noted that even though the system is vented, the second piston 58 is still in the downward position causing the fingers 98 to remain open under the influence of the mechanical spring 64. This is important for it assures that if the prethreaded closure 118 was defective, or if the threads were stripped during the threading process, or if there was a broken bottle under the chuck 90, the closure 118 would still be allowed to drop out. This action clears the fingers 98 so they can pick up another prethreaded closure 118 for the next container. As the air pressure behind the first piston 50 is vented to the atmosphere, the spring 72 will cause the arm 66 to pivot back to its initial position. As this occurs, the first poppet valve 52 will be urged back to its inward position by the arm 66, and the second poppet valve 54 will be moved outward under the influence of its biasing spring. This final position is shown in FIG. 16. The capping head 10 will then vertically move upward and in a circular arc so as to be in position to pick up another prethreaded closure 118 and to thread it onto another container.

While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

We claim:

1. A capping head comprising a housing adapted to be secured to a drive spindle, a quill mounted in said housing for free rotation therewith and containing a pair of poppet valves, a torque-dependent clutch having a drive plate connected to said housing and a driven plate connected to said quill, a chuck capable of gripping a prethreaded closure attached to said driven plate and fluidly activated between an open and a closed position by said poppet valves, activating means attached to said quill and cooperating with said housing to selectively operate said poppet valves when the torque value between said drive plate and said driven plate exceeds a predetermined value, and conduit means for routing pressurized fluid to and from said poppet valves.

2. The capping head of claim 1 wherein said activating means includes an arm pivotally attached to said quill so as to selectively activate one of said poppet valves, and a cam follower attached to an end of said arm which contacts a cam formed on an inner circumferential surface of said housing.

3. The capping head of claim 2 wherein said poppet valves are arranged longitudinally in-line on said quill in radial bores and said arm is pivotally connected between said pair of poppet valves.

4. The capping head of claim 1 wherein said poppet valves are 3-way, 2-position valves.

5. A capping head for screwing a prethreaded closure onto a container, said capping head comprising:

(a) a housing adapted to be secured to a rotatable drive spindle and having a cam formed on an inner circumferential surface thereof;

(b) a quill mounted in said housing for free rotation therewith, said quill containing a pair of radially aligned poppet valves;

(c) a torque-dependent clutch having a drive plate secured to said housing and a driven plate secured to said quill, said clutch being capable of stopping the screwing of a screw closure onto said container when a predetermined desired torque is reached;

(d) a chuck secured to said driven plate for rotation therewith and being fluidly connected to said poppet valves for movement between a closed position whereby said screw closure is gripped and an open position whereby said screw closure is released;

(e) activating means for selectively operating said poppet valves by traversing said cam when the torque between said drive plate and said driven plate exceeds a predetermined value; and (f) conduit means for routing pressurized fluid to and from said poppet valves.

6. The capping head of claim 5 wherein said activating means includes an arm pivotally attached to said quill so as to selectively activate one of said poppet valves and a cam follower attached to an end of said arm which contacts said cam.

7. The capping head of claim 5 wherein said arm is spring biased to ensure that said cam follower engages said cam.

8. The capping head of claim 5 wherein said clutch is a non-frictional clutch with permanent magnets mounted on facing surfaces of said drive plate and said driven plate, and the poles of said magnets are arranged so that said drive plate and said driven plate attract each other at least in one relative position.

9. The capping head of claim 5 wherein said chuck is comprised of at least two gripper fingers.

10. The capping head of claim 5 wherein said poppet valves are 3-way, 2-position valves.

11. A capping head for screwing a prethreaded closure onto a container provided with a screw thread, said capping head comprising:

(a) a housing adapted to be secured to a rotatable drive spindle having a bore formed therein which is open at one end and having a cam formed on an inner circumferential surface thereof:

(b) a quill mounted in said housing for free rotation therewith, said quill having two radial bores formed therein which receive a first and a second poppet valve, respectively, and a coaxial bore formed therein which is open at one end;

(c) a non-frictional, torque-dependent clutch which stops screwing a screw closure onto said container when a predetermined desired torque is reached, said clutch having a drive plate secured to said housing adjacent to said open end and a driven plate secured to said quill, said drive plate and said driven plate having permanent magnets on facing surfaces thereof which are retained in a spaced-apart relationship;

(d) a piston rod partially positioned in said coaxial bore formed in said quill and axially movable by pressurized fluid, said piston rod supporting a piston;

(e) a chuck secured to said driven plate for rotation therewith and affixed to an end of said piston rod for axial movement therewith, said chuck having a plurality of fingers which are movable between a closed position whereby a screw closure is gripped when said piston is pressurized on one side and an open position whereby said screw closure is released when said piston is pressurized on the opposite side;

(f) activating means for selectively operating said first and second poppet valves by traversing said cam when the torque between said drive plate and said driven plate exceed a predetermined value, said activating means including an arm pivotally attached to said quill and a cam follower attached to an end of said arm which contacts said cam; and (g) conduit means for routing pressurized fluid to and from said first and second poppet valves and said piston.

12. The capping head of claim 11 wherein said pressurized fluid is air.

13. The capping head of claim 11 wherein said activating arm is pivotally attached between said first and second poppet valves.

14. The capping head of claim 13 wherein said arm is spring biased to ensure that said cam follower engages said cam.

15. The capping head of claim 11 wherein said piston is spring-biased to a position which causes said fingers to move toward said open position releasing said screw closure.

16. The capping head of claim 11 wherein said first and second poppet valves are 3-way, 2-position valves.

17. The capping head of claim 11 wherein said chuck has four fingers each having a concave gripping surface.

18. The capping head of claim 17 wherein said four fingers are arranged in a circular pattern with each finger being 90° out-of-phase with the adjoining fingers.

19. The capping head of claim 11 wherein said fingers are attached at their bases to a retainer ring which permits pivotal motion and said retainer ring is securely attached to said driven plate.

20. A capping head for screwing a prethreaded closure onto a container provided with a screw thread, said capping head comprising:

(a) a housing adapted to be secured to a rotatable drive spindle having a bore formed therein which is open at one end and having a cam formed on an inner circumferential surface thereof;

(b) a quill mounted in said housing for free rotation therewith, said quill having three radial bores formed therein which are arranged in-line and a coaxial bore formed therein which is open at one end, said bores retaining a first piston, a first poppet valve, a second poppet valve and a piston rod, respectively;

(c) a non-frictional, torque-dependent clutch which stops screwing a prethreaded closure onto said container when a predetermined desired torque is reached, said clutch having a drive plate secured to said housing adjacent to said open end and a driven plate secured to said quill, said drive plate and said driven plate having permanent magnets on facing surfaces thereof which are retained in a spaced-apart relationship;

(d) a second piston mounted on said piston rod and being movable by pressurized fluid relative to said open end of said quill;

(e) a chuck secured to said driven plate for rotation therewith and affixed to an end of said piston rod for axial movement therewith, said chuck having a plurality of fingers which are movable between a closed position whereby a prethreaded closure is gripped when said second piston is pressurized on one side and an open position whereby said prethreaded closure is released when said piston is pressurized on the opposite side;

(f) activating means for selectively operating said first and second pistons and said first and second poppet valves, said activating means including an arm pivotally attached to said quill, one end of said arm being in constant contact with said first piston and the other end of said arm having a cam follower attached thereto which traverses said cam when the torque between said drive plate and said driven plate exceeds a predetermined value; and (g) conduit means for routing pressurized fluid to and from said first and second pistons and said first and second poppet valves.

21. The capping head of claim 20 wherein said arm is spring-biased outwardly such that said cam follower is in constant contact with said cam.

22. The capping head of claim 20 wherein said first and second poppet valves are 3-way, 2-position valves.

* * * * *